US006234458B1

(12) United States Patent
Gerhardy

(10) Patent No.: US 6,234,458 B1
(45) Date of Patent: May 22, 2001

(54) CARBURETOR WITH SECURED CONTROL SCREW

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/360,114

(22) Filed: Jul. 23, 1999

(30) Foreign Application Priority Data

Jul. 25, 1998 (DE) ..... 198 33 541

(51) Int. Cl.[7] ..... F02M 3/08

(52) U.S. Cl. ..... 261/71; 261/DIG. 68; 261/DIG. 84

(58) Field of Search ..... 261/34.1, 35, 71, 261/37, 64.1, 54, 69.1, 69.2, DIG. 23, DIG. 24, DIG. 38, DIG. 39, DIG. 68, DIG. 83, DIG. 84

(56) References Cited

U.S. PATENT DOCUMENTS

| | | | | |
|---|---|---|---|---|
| 3,618,906 | | 11/1971 | Charron | 261/71 X |
| 4,283,353 | * | 8/1981 | Miller | 261/DIG. 84 |
| 4,936,267 | * | 6/1990 | Gerhardy et al. | 261/35 X |
| 5,236,634 | | 8/1993 | Hammett et al. | 261/DIG. 38 |
| 5,252,261 | * | 10/1993 | Gerhardy | 261/DIG. 84 |
| 5,283,013 | * | 2/1994 | Gerhardy | 261/DIG. 68 |
| 5,525,267 | * | 6/1996 | Araki | 261/71 |
| 5,630,965 | * | 5/1997 | Shaw et al. | 261/71 |
| 5,635,113 | * | 6/1997 | Walsh et al. | 261/71 |
| 5,707,561 | * | 1/1998 | Swanson | 261/DIG. 84 |
| 5,776,379 | * | 7/1998 | Bowles | 261/DIG. 84 |
| 6,059,271 | * | 5/2000 | Gerhardy | 261/DIG. 68 |

FOREIGN PATENT DOCUMENTS

| | | | | |
|---|---|---|---|---|
| 2401803 | * | 9/1974 | (DE) | 261/DIG. 84 |
| 0 589 405 A1 | | 3/1994 | (EP) . | |
| 47-42424 | * | 10/1972 | (JP) | 261/DIG. 84 |
| 641145 | * | 1/1979 | (SU) | 261/DIG. 84 |

* cited by examiner

*Primary Examiner*—Richard L. Chiesa
(74) *Attorney, Agent, or Firm*—Robert W. Becker & Associates

(57) ABSTRACT

A carburetor for an internal combustion engine of a hand-held working tool has a housing having an intake channel and a fuel-filled control chamber mounted in the housing. A fuel channel is connected to the control chamber and the intake channel. A control valve is mounted in the fuel channel and has a valve member. A control screw is mounted in the carburetor housing and acts on the valve member for adjusting it. A cap is fixedly mounted on the control screw and has a stop. A counter stop is mounted on the housing in a rotational path of the stop of the cap. A locking device for securing the cap relative to the housing is provided. The locking device has a locking member and counter locking members cooperating with the locking member for locking the cap in one of various preset positions relative to the housing.

19 Claims, 2 Drawing Sheets

CARBURETOR WITH SECURED CONTROL SCREW

BACKGROUND OF THE INVENTION

The present invention relates to a carburetor for an internal combustion engine, especially for the internal combustion engine of a portable, hand-guided working tool such as a motor chainsaw etc., wherein the carburetor comprises a carburetor housing with intake channel and with a fuel channel opening into the intake channel. The fuel channel is connected to a fuel-filled control chamber of the carburetor and has a control valve arranged therein. The control member of the control valve is adjustable by a control screw that is mounted within the housing. For limiting the adjusting range of the valve member, a cap is fixedly mounted on the control screw and has a stop, whereby a counter stop connected to the carburetor housing is positioned in the rotational path of the stop at the cap.

Such a carburetor is known from U.S. Pat. No. 3,618,906. The fuel channel opening into the intake channel has a control valve which is embodied as a needle valve and whose control screw is screwed into the carburetor housing. In order to limit the adjusting range of the needle valve, a securing cap is snapped onto the knurled head of the control screw after a pre-adjustment has been performed at the manufacture. The securing cap has an outer stop, and a counter stop at the carburetor housing projects into the rotational path of this stop. The adjusting range of the control screw is thus limited to less than one complete rotation.

For securing the rotational position of the control screw springs, friction rings etc. must be provided.

As a function of the ambient temperature as well as of the altitude, the supplied fuel amount must be adjusted by rotation of the control screw. This is performed by the user whereby, depending on the dexterity of the user, a more or less satisfactory adjustment can be achieved.

It is therefore an object of the present invention to embody a carburetor of the aforementioned kind such that even an inexperienced user can perform the required adjustment of the fuel/air mixture to the operating condition in a simple manner.

SUMMARY OF THE INVENTION

This object is inventively solved by providing a locking device between the cap-and the carburetor housing that secures the cap at the housing. The locking device has a locking member that cooperates with correlated counter locking members for securing the cap in a predetermined rotational position.

The locking device positioned between the cap and the carburetor housing provides certain rotational positions of the control screw for the user whereby the predetermined rotational positions that depending on the type of carburetor, the combustion engine and the environmental conditions to be expected are preset by physical means of the inventive design. Even an inexperienced user can perform an adaptation to the environmental conditions in a simple manner according to a reference list. For example, when the location of use is at an altitude of a thousand meters, according to the operators manual a rotation of the control screw by two preset positions can be suggested in order to provide the required altitude adjustment of the fuel/air mixture to a leaner mixture.

Due to the inventively arranged locking device further securing means such as clamping rings etc. for a rotational securing action of the control screw can be eliminated.

The counter locking member has expediently a locking depression in which the projecting nose of the locking member will engage. The counter locking member may be embodied as a locking tongue so that the counter stop secured to the housing can be used as the locking member. Preferably, the locking member is embodied as a locking rib at the housing so as to be, on the one hand, a part of the locking device and, on the other hand, a part of the rotational limitation device, i.e., it has a double function.

In an expedient further embodiment of the invention, the cap is comprised of a connecting portion, that is fixedly connected to the control screw, and a bushing portion, which is axially connected to the connecting portion and faces the carburetor housing. The bushing portion is arranged coaxial to the control screw and surrounds the control screw with radial play. The mantle of the bushing portion is preferably divided by axial slots to form locking tongues whereby the radial play relative to the control screw provides a radial spring action of the locking tongues. The locking member can thus be provided at the housing and is preferable a unitary part of the carburetor housing.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

Figure 1:
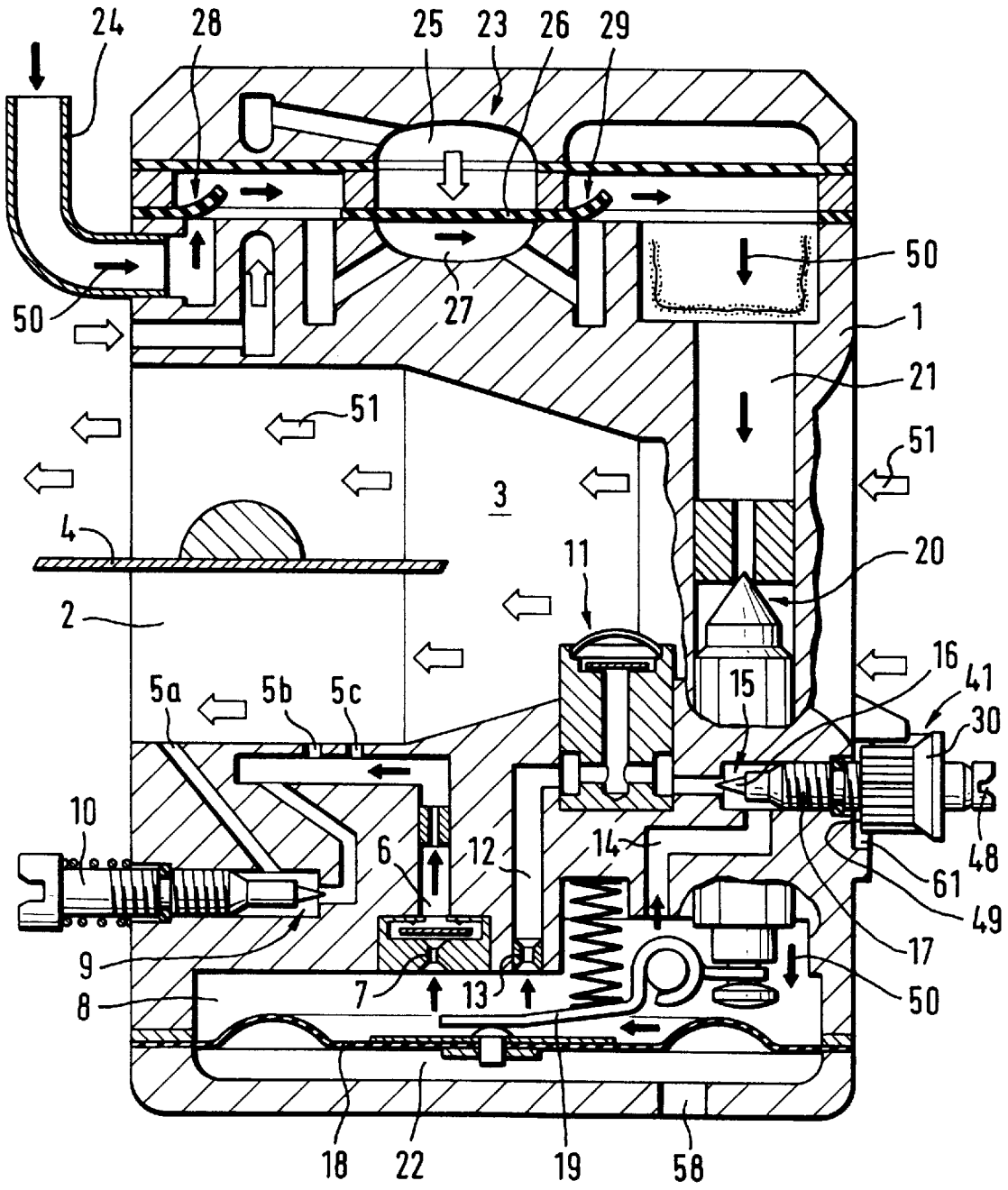
FIG. 1 shows a section of a carburetor.

The carburetor represented in FIG. 1 for an internal combustion engine is a diaphragm carburetor as is conventional in internal combustion engines for portable, hand-guided working tools such as motor chainsaws, cutters, trimmers etc. The internal combustion engine with which the carburetor can be used may be a two-stroke internal combustion engine with oil-in-gas lubrication or a four-stroke internal combustion engine with separate lubrication system or oil-in-gas lubrication.

The represented carburetor has a carburetor housing with an intake channel 2 mounted therein having a venturi section 3. In the intake channel a throttle valve 4 is provided, and idle bores 5*a*, 5*b*, 5*c* open into the pivot range of this throttle valve. The idle bores 5*a*, 5*b*, 5*c* are supplied with fuel via a fuel channel 6, having throttle 7 arranged therein and connected to a fuel-filled control chamber 8. The idle bore 5*a* positioned upstream of the throttle valve 4 is connected by control valve 9 to the fuel channel 6 whereby the control valve 9 can be adjusted by a control screw 10 inserted into the carburetor 1.

Upstream of the throttle valve 4 the outlet valve 11 opens into the venturi section. It is in communication via fuel channel 12 and throttle 13, on the one hand, and fuel channel 14 with control valve 15, on the other hand, to the fuel-filled control chamber 8. The valve member 16 of the control valve 15 is a needle valve and is arranged at the end of the control screw 17 which is threaded into the carburetor housing 1.

The control screw 17 supports at one end the valve needle 16 of the needle valve 15 and is threaded with a portion adjacent to the valve needle 16 into the carburetor. The circumferential groove 53 provided at one end of the threaded portion 52 can receive as a sealing means an O-ring 54 so that penetration of dirt is prevented and, furthermore, additional sealing of the fuel channel 14, respectively, the valve 15 is provided. The O-ring acts between the bore 57 of the carburetor housing 1 and the control screw 17.

The fuel-filled fuel chamber 8 is limited by a diaphragm 18 which controls by lever 19 the valve member of the supply valve 20 arranged in the fuel supply channel 21. The side of the diaphragm 18 facing away from the control chamber 8 delimits a compensation chamber 22 which is connected by opening 58 to the atmosphere.

The fuel supply channel 21 is supplied by fuel pump 23 with fuel that is sucked in via suction socket 24 from a non-represented fuel container. The fuel pump 23 is comprised of a working chamber 25 which is loaded by the fluctuating pressure within the crankcase of the internal combustion engine and is separated by diaphragm 26 from the pumping chamber 27. At the inlet side the pumping chamber 27 has a check valve 28 which opens in the conveying direction and at the exit side it has a check valve 29 which opens also in the conveying direction.

The fuel pump 23 which, when the internal combustion engine is in operation, is driven by the fluctuating crankcase pressure conveys according to arrows 50 fuel via the supply valve 20 into the control chamber 8 from where the fuel is supplied by vacuum present within the intake channel 2 via fuel channel 6, 12, and 14 to the idle bores 5*a*, 5*b*, 5*c* and the main outlet valve 11. Combustion air flows according to arrows 51 in the intake channel 2 whereby the upstream the valves of fuel/air mixture is formed.

The fuel amount supplied to the main outlet valve 11 is divided by the fixed throttle 13 into a fixed amount and by the control valve 15 into an auxiliary amount. The auxiliary amount of fuel which is supplied by the control valve 15 can be preset according to the engine specifications whereby it must be insured that via the control valve 15 only a maximum auxiliary fuel amount can be supplied in order to ensure under full load the desired exhaust gas qualities.

Figure 2:
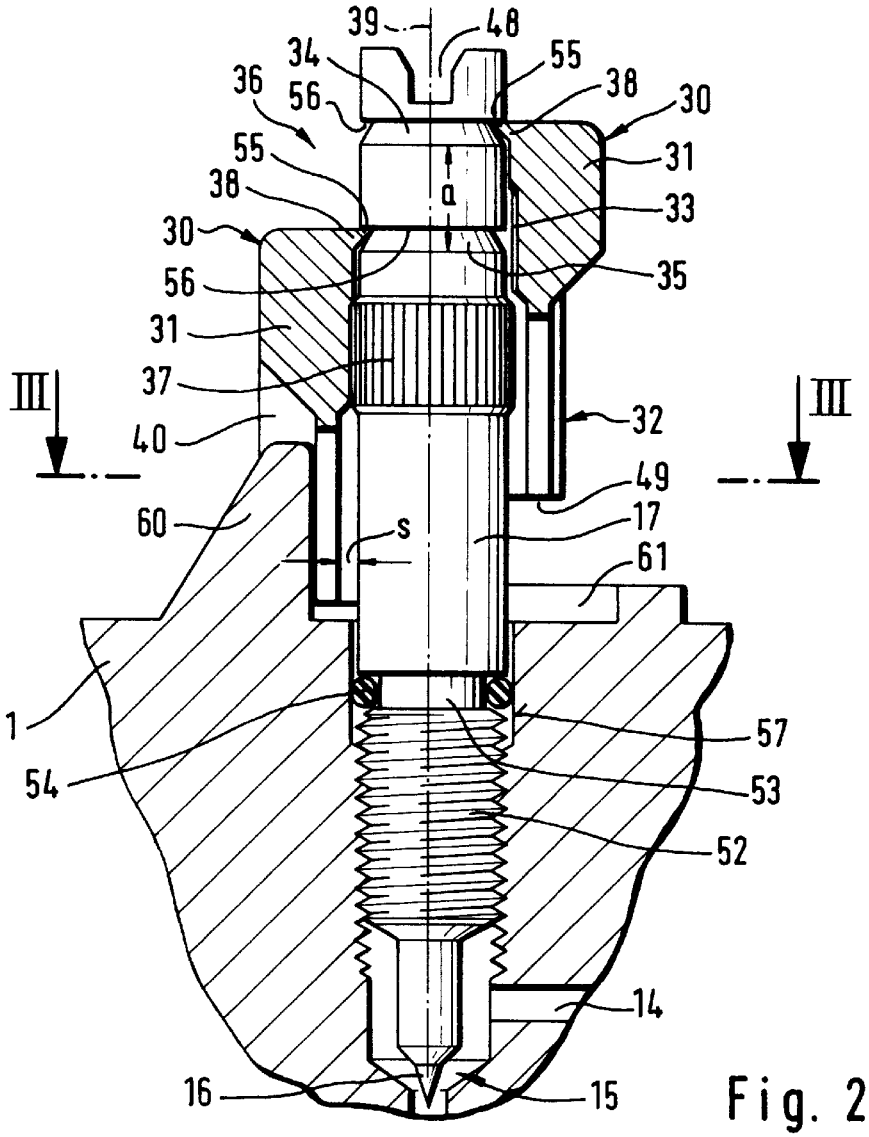
FIG. 2 shows in an enlarged partial representation a section of the control screw with locking device screwed into the carburetor housing.
Figure 3:
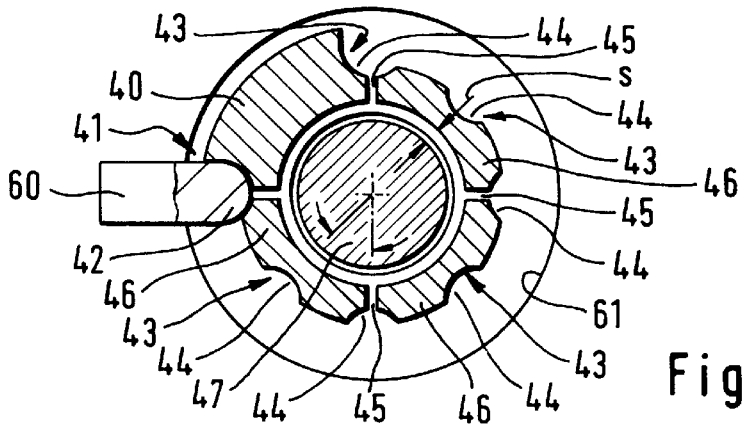
FIG. 3 shows a sections along the line III—III of FIG. 2.

For limiting the rotational stroke of the control screw 17 of the control valve 15 and thus the maximum auxiliary fuel amount, a cap is fixedly mounted on the control screw 17, as is shown in detail in FIGS. 2 and 3. The cap 30 is comprised of the fastening portion 31 that is fixedly connected to the control screw 17 and a bushing portion 32 axially connected thereto. The bushing portion 32 is positioned approximately coaxially and with radial play s relative to the control screw 17. The connecting portion 31 has an inner knurled portion 33 which, in the mounted position of the cap, cooperates with the knurled portion 37 of the control screw 17. In FIG. 2 on the left side the mounted cap 30 is shown in its end position, while on the right side the pre-assembled cap 30 is represented. The pre-assembled position and the end position are determined by circumferential grooves 34, 35 positioned with axial spacing on the end portion 36 of the control screw 17. The circumferential grooves 34, 35 receive the inner circumferential locking bead 38 of the locking portion in a snap-in connection. The axial spacing a of the circumferential groove 34 to the groove 35 determining the premounted state is such that the inner knurled portion 33 of the fastening portion 31 is disengaged from the knurled portion 37 of the control screw 17. The cap 30 in this premounted state is freely rotatable relative to the control screw 17 about its longitudinal center axis 39. It is secured axially by the locking bead 38 engaging the circumferential groove 34. In the end positioned represented in the left half of FIG. 2, the locking bead 38 is snapped into the lower circumferential groove 35 whereby the inner knurled portion 33 of the fastening portion 31 is fixedly connected to the knurled portion 37 of the control screw. Expediently, the connecting portion 31 with its locking edge 55 provided at the locking bead 38 is used for engaging so that an axial return of the cap 30 is prevented and a securing action against manipulation is provided. The circumferential groove 35 is in section V-shaped whereby the leg 56 facing the screw head extends at a right angle to the longitudinal axis 39 of the control screw 17 and cooperates with the locking edge 55. The V design of the circumferential grooves 34, 35 with the respective leg 56 extending at a right angle to the longitudinal axis allows for an easy slipping of the cap 30 onto the control screw 17, but makes it impossible to remove the cap from the control screw without destroying the cap, respectively, its locking mechanism.

For limiting the rotational movement, the cap is provided at the outer periphery of the bushing portion 32 with a stop 40, whereby a counter stop 60 connected to the housing projects into its rotational path. The stop 40 of the cap 30 is embodied as an axial rib on the outer periphery of the bushing portion 32 of the cap 30 while the counter stop 60 is a unitary (monolithic) part of the carburetor housing 1. It is shaped as a cam which extends approximately over the height or length of the bushing portion 32.

Between the bushing portion 32 of the cap 30 and the carburetor housing 1, the locking device 41 is provided. It has a locking member 42 cooperating with physically preset rotational positions of the cap 30 defined by locking counter members 43 in order to secure the cap 30 and with it the control screw 17 in a fixed position by physically predetermined rotational positions.

The locking member 42 is expediently a locking cam fixedly secured at the housing and providing at the same time the counter stop 60. The counter locking members 43 have locking depressions 44 into which the rounded longitudinal edge of the locking member 42 projects as a locking nose. The counter locking members 43 are embodied as locking tongues 46 which extend axially to the longitudinal center axis 39 of the control screw 17, respectively, the cap 30 and are expediently unitary parts of the cap 30. For this purpose, the mantle of the bushing portion 32 is divided by axial slots 45 into locking tongues 46 arranged preferably uniformly in the circumferential direction. In the shown embodiment, four axial slots 45 are provided which extend over the entire length of the bushing portion 32 and divide the mantle into four locking tongues 46 extending over and angular distance of approximately 90°. One of the locking tongues 46 supports the stop 40 of the cap 30 embodied as an axial rib whereby adjacent to the axial stop 40 a counter locking members 43 are arranged in the circumferential direction.

The counter locking members 43 formed by the locking tongue 46 have a preferably centrally arranged locking depression 44 which is embodied as an outer axial groove in the mantle of the bushing portion 32. Preferably, between two locking tongues 46 a further locking depression 44 which is divided by the axial slot 45 is provided which also extends as an axial groove in the direction of the longitudinal center axis 39 of the control screw 17. It is thus divided by the respective axial slot 45 into two portions. Accordingly, the bushing portion 32 has across its circumference uniformly distributed four locking depressions 44 divided by the axial slots 45. In addition, each one of the locking tongues 46 has a centrally arranged locking depressions 44 so that across the circumference seven depressions 44 are uniformly distributed. The locking depressions 44 are positioned at a circumferential spacing 47 of approximately 45° relative to one another so that in the shown embodiment an adjusting range of 270° (¾ of a complete revolution) is provided with seven physically preset locking locations.

The carburetor is assembled by the manufactures with a premounted cap 30 (right side of FIG. 2) and during final adjustment of the internal combustion engine the control screw is rotated to a maximum allowable open position of the control valve 15. Subsequently, the cap 30 is then snapped into the end position (left side of FIG. 2) whereby an end portion of the screw 17 having an insertion slot 48 for a tool penetrates the cap 30. In the mounted end position of the cap 30, the stop 40 and the counter stop 60 at the housing counteract a further rotation of the control screw 17 and thus a further opening of the control valve 15. In order to prevent manipulation at the cap 30, the end 49 facing the carburetor housing 1 projects into a recess 61 so that the engaging end 49 of the bushing portion 32 is surrounded with minimal play by the recess 61. The user can adjust the control screw 17 in the direction of closing of the control valve 15 and can thus adjust a leaner fuel/air mixture which is, for example, expedient for an output-optimized rpm adaptation or for altitude adjustment. The possible preset rotational positions of the control screw 17 are provided by the locking connection 41. Depending on the type of carburetor, a fine adjustment by many adjusting steps is possible, for example, nine adjusting steps with a circumferential spacing of 35° or even 15 steps with a circumferential spacing of 21° or a somewhat more coarse adjustment with minimal adjusting stages, for example, three adjusting stages having a circumferential spacing of 105° or five adjusting stages having a circumferential spacing of 63°.

The specification incorporates by reference the disclosure of German priority document DE 198 33 541.5 of Jul. 25, 1998.

The present invention is, of course, in no way restricted to the specific disclosure of the specification and drawings, but also encompasses any modifications within the scope of the appended claims.

What is claimed is:

1. A carburetor for an internal combustion engine of a hand-held working tool, said carburetor comprising:

a housing (1) having an intake channel (2);

a fuel-filled control chamber (8) mounted in said housing (1);

a fuel channel (14) connected to said control chamber (8) and said intake channel (2);

a control valve (15) mounted in said fuel channel (14);

said control valve (15) having a valve member (16);

a control screw (17) mounted in said housing (1) and acting on said valve member (16) for adjusting said valve member (16);

a cap (30) fixedly mounted on said control screw (17); said cap (30) having a stop (40);

a counter stop (60) mounted on said housing (1) in a rotational path of said stop (40);

an auxiliary locking device (41) for securing said cap (30) relative to said housing (1) positioned between said cap (30) and said housing, said auxiliary locking device (41) having an adjusting range of approximately 270°;

said locking device (41) having a locking member (42) and counter locking members (43) cooperating with said locking member (42) for locking said cap (30) in one of various preset positions relative to said housing (1), said locking device adapted to secure said control screw (17) into a plurality of locking positions independently of said stop (40) and said counter stop (60).

2. A carburetor according to claim 1, wherein said counter locking members (43) have depressions (44) and wherein said locking member (42) has a projecting nose engaging said depressions (44).

3. A carburetor according to claim 1, wherein said counter locking members (43) have locking tongues (46).

4. A carburetor according to claim 3, wherein said locking tongues (46) are unitary parts of said cap (30) and extend in a direction of a longitudinal axis (39) of said cap (30).

5. A carburetor according to claim 1, wherein said counter stop (60) is said locking member (42) and is a stationary locking cam.

6. A carburetor according to claim 1, wherein said stop (40) of said cap (30) is an axial rib located at an outer periphery of said cap (30) and wherein said counter locking members (43) are arranged adjacent to said axial rib (40) in a circumferential direction of said cap (30).

7. A carburetor according to claim 2, wherein said cap (30) is comprised of a connecting portion (31) fixedly connected to said control screw (17) and a bushing portion (32) axially connected to said connecting portion (31), wherein said bushing portion (32) is coaxially positioned to said control screw (17) and surrounds said control screw (17) at a radial spacing (s).

8. A carburetor according to claim 7, wherein said bushing portion (32) has a mantle with axial slots (45), wherein said axial slots (45) divide said mantle into locking tongues (46) forming said counter locking members.

9. A carburetor according to claim 8, wherein said stop (40) of said cap (30) is connected to one of said locking tongues (46).

10. A carburetor according to claim 8, wherein some of said depressions (44) extend in two neighboring ones of said locking tongues (46) and are divided by said axial slots (45) between said two neighboring locking tongues (46).

11. A carburetor according to claim 7, wherein said connecting portion (31) is positive-lockingly axially snapped onto said control screw (17).

12. A carburetor according to claim 7, wherein an end portion (36) of said control screw (17) penetrates said cap (30) and has an insertion slot (48) for a tool.

13. A carburetor according to claim 1, wherein said housing (1) has a recess (61) and wherein an end (49) of said cap (30) facing said housing (1) projects into said recess (61).

14. A carburetor for an internal combustion engine of a hand-held working tool, said carburetor comprising:

a housing (1) having an intake channel (2);

a fuel-filled control chamber (8) mounted in said housing (1);

a fuel channel (14) connected to said control chamber (8) and said intake channel (2);

a control valve (15) mounted in said fuel channel (14);

said control valve (15) having a valve member (16);

a control screw (17) mounted in said housing (1) and acting on said valve member (16) for adjusting said valve member (16);

a cap (30) fixedly mounted on said control screw (17);

said cap (30) having a stop (40), said cap (30) comprising a connecting portion (31) fixedly connected to said control screw (17) and a bushing portion (32) axially connected to said connecting portion (31), wherein said bushing portion (32) is coaxially positioned to said control screw (17) and surrounds said control screw (17) at a radial spacing(s);

a counter stop (60) mounted on said housing (1) in a rotational path of said stop (40);

a locking device (41) for securing said cap (30) relative to said housing (1);

said locking device (41) having a locking member (42) and counter locking members (43) cooperating with said locking member (42) for locking said cap (30) in one of various preset positions relative to said housing (1), said counter locking members (43) having depressions (44) and wherein said locking member (42) has a projecting nose engaging said depressions (44).

15. A carburetor according to claim 14, wherein said bushing portion (32) has a mantle with axial slots (45), wherein said axial slots (45) divide said mantle into locking tongues (46) forming said counter locking members.

16. A carburetor according to claim 15, wherein said stop (40) of said cap (30) is connected to one of said locking tongues (46).

17. A carburetor according to claim 15, wherein some of said depressions (44) extend in two neighboring ones of said locking tongues (46) and are divided by said axial slots (45) between said two neighboring locking tongues (46).

18. A carburetor according to claim 14, wherein said connecting portion (31) is positive-lockingly axially snapped onto said control screw (17).

19. A carburetor according to claim 14, wherein an end portion (36) of said control screw (17) penetrates said cap (30) and has an insertion slot (48) for a tool.

* * * * *